US007757418B1

(12) United States Patent
Clark et al.

(10) Patent No.: US 7,757,418 B1
(45) Date of Patent: Jul. 20, 2010

(54) DISPLAY APPARATUS AND METHOD

(75) Inventors: Jeremy A. Clark, Minneapolis, MN (US); Michael A. Whittier, Minneapolis, MN (US); David Cheney, St. Paul, MN (US); Thomas A. Leeds, Oaklawn, IL (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 12/425,657

(22) Filed: Apr. 17, 2009

(51) Int. Cl.
*G09F 7/00* (2006.01)

(52) U.S. Cl. ..... 40/605

(58) Field of Classification Search ..... 40/605, 40/610, 611.05, 611.08; 211/85.3, 85.4, 211/85.17, 45, 50, 13.1, 85.1, 72, 73, 70.1; 312/114, 118, 119, 257.1, 258, 259, 265.6; 248/460, 150; 206/455
See application file for complete search history.

(56) References Cited

U.S. PATENT DOCUMENTS

| | | | |
|---|---|---|---|
| 2,737,742 | A | 3/1956 | Leigh |
| 2,762,148 | A | 9/1956 | Alcaraz |
| 2,824,395 | A | 2/1958 | Decker et al. |
| 3,113,392 | A | 12/1963 | Downing |
| 3,205,600 | A | 9/1965 | Snyder |
| 3,322,382 | A | 5/1967 | Rohrbach |
| 3,523,382 | A | 8/1970 | Dreyer |
| 4,372,086 | A | 2/1983 | Hanlon |
| 6,038,797 | A | 3/2000 | Smith |
| 6,126,254 | A | 10/2000 | Maglione |
| 6,378,710 | B1 | 4/2002 | Gruenberg |
| 6,382,433 | B1 | 5/2002 | Podergois |
| D522,769 | S | 2/2006 | Davis |
| D512,274 | S | 5/2006 | Dusenberry |
| 7,252,200 | B1 | 8/2007 | Hester |
| D554,896 | S | 11/2007 | Post |
| D559,013 | S | 1/2008 | McLaughlin et al. |
| D560,073 | S | 1/2008 | Amezola Portuondo |
| 2007/0234621 | A1 | 10/2007 | McCorkle |

*Primary Examiner*—Joanne Silbermann
*Assistant Examiner*—Shin Kim
(74) *Attorney, Agent, or Firm*—Fish & Richardson P.C.

(57) ABSTRACT

Some embodiments of a display fixture can display a variety of products or images of available products in an appealing manner that draws attention from consumers. In some cases, the display fixture may employ a number of graphic inserts that fit within display windows to show images related to available products.

20 Claims, 7 Drawing Sheets

DISPLAY APPARATUS AND METHOD

TECHNICAL FIELD

This disclosure relates to a display apparatus showing products or images of available products.

BACKGROUND

Display fixtures can be used in retail stores or other environments to present various products to consumers. The display fixtures may retain the product packages therein or present images of the products in view of the consumers. For example, greeting cards, carpet samples, magazines, and other products may be displayed in trays or slots of a designated display fixture. Such a display fixture can be arranged along an aisle in a store so that consumers walking by the display fixture can grasp selected products.

In another example, a display fixture may present images of various fabric colors or clothing combinations to promote particular products arranged near the display fixture. Such display fixtures may include signage that is mounted above hangers carrying articles of clothing. Moreover, clothing articles and other products may be displayed inside store window displays. In these traditional store window displays, the products may be arranged on a fixture behind a transparent pane so that shoppers passing by the window can view the products therein.

In a further example, samples of clothing articles can be mounted to a wall above a fixture rack that carries those clothing articles in various sizes. Alternatively, images of the clothing articles can be mounted to the wall above the fixture rack that carries the clothing articles in various sizes. In both scenarios, a shopper may view the sample clothing articles or the images of the clothing articles mounted to the wall and approach the wall so as to find a clothing article in his or her size.

In some circumstances, a number of display fixtures can be manufactured in a first location and then shipped to a second location for assembly and display in a retail environment. A store worker may assemble a display fixture in a retail store environment. Often times, the worker may not have access to a wide selection of tools during the assembly process. Furthermore, the complexity of the assembly process can be increased if the display fixture is shipped in a dissembled condition with numerous hardware components.

SUMMARY

Some embodiments of a display fixture can display a variety of products or images of available products in an appealing manner that draws attention from consumers. In some cases, the display fixture may employ a number of graphic inserts that fit within display windows to show images related to available products. The graphic inserts can fit into the display windows at a predetermined depth, and the graphic inserts may be reversible so as to rest in the display window at different depths. Furthermore, the display fixture can be shipped in a substantially flat condition to a display location and then readily assembled to an expanded condition by a store worker. In such circumstances, the display fixture may include a number of components that are assembled to one another without the use of handheld tools, thereby providing added convenience to the store worker and an attractive display fixture to the consumers.

In particular embodiments, a product display apparatus may include one or more display windows defined by a plurality of vertical support members and a plurality of horizontal support members. The plurality of vertical support members may be adjustable from a flat configuration to an operative configuration. Also, the plurality of horizontal support members may be adjustable from a flat configuration to an operative configuration. The apparatus may further include an image-bearing insert frictionally engaged in each of the display windows so as to expose from the display window a first image on a first major surface of the image-bearing insert. The image-bearing insert may comprise a plurality of foldable flaps that abut with inner walls of the display window defined by the plurality of vertical support members and the plurality of horizontal support members. The first major surface of the image-bearing insert may rest at a first depth in the display window when the foldable flaps extend forward from the first major surface of the image-bearing insert. The first major surface of the image-bearing insert may rest at a second different depth in the display window when the foldable flaps extend rearward from the first major surface of the image-bearing insert.

Some embodiments include a product display fixture that is ceiling-mounted in a retail store environment. The display fixture may include an array of display openings defined by a plurality of vertical support columns that are toollessly mounted to a plurality of horizontal support members. Each of the vertical support columns may be adjustable from a flat configuration to a folded configuration, and each of the horizontal support members may be adjustable from a flat configuration to a folded configuration. The display fixture may also include one or more mounting supports extending upward away from the display openings and coupled to a ceiling mounting rack so that the array of display openings is suspended from the ceiling mounting rack. The display fixture may further include a plurality of graphic planar members arranged in the array of display openings. Each of the graphic planar members may have a first image related to store products arranged on a first major surface and a second different image arranged on a second major surface opposite from the first major surface. Each of the graphic planar members may comprise a plurality of foldable flaps that abut with inner walls of a corresponding display opening in the array of display openings. Each of the graphic planar members may be adjustable from a first orientation in which the first image is exposed from the corresponding display opening to a second orientation in which the second different image is exposed from the corresponding display opening.

Certain embodiments may include a method of assembling a product display apparatus. The method may include receiving one or more stacks of a plurality of vertical support members, a plurality of horizontal support members, and a plurality of image-bearing panels. The method may also include adjusting each of the vertical support members, horizontal support members, and image-bearing panels from a flat configuration to a folded configuration. The method may further include toollessly mounting the plurality of vertical support members to the plurality of horizontal support members to define an array of display windows. The method may include releasably securing the image-bearing panels in the array of display windows so that images on first major surfaces of the image-bearing panels are displayed forward through the array of display windows while images on second major surfaces of the image-bearing inserts face rearwardly. The method may also include mounting one or more of the vertical support members and horizontal support members to a ceiling or wall in a retail store environment so that the display windows and image-bearing panels are viewable in the retail store environment.

These and other embodiments described herein may provide one or more of the following advantages. First, some embodiments of the display fixture can display a variety of products or product-related images in an attractive manner. Second, the display fixture may have a modular construction such that the number of display windows can be readily selected or changed at the display site. Third, each display window can receive a graphic insert to show images related to available products. The graphic inserts may be reversible so as to rest in the display window at a first depth when in a first orientation and to rest in a second different depth when in a second orientation. Fourth, the display fixture can be shipped in a substantially flat condition to a display location and then readily assembled to an expanded condition by a store worker. Accordingly, the transport costs for the display fixture can be significantly reduced, and multiple display fixtures may be transported in bulk. Fifth, the display fixture may include a number of components that are assembled to one another without the use of handheld tools. By assembling the display fixture in such a toolless manner, the burden upon the worker can be reduced during the assembly process.

DETAILED DESCRIPTION OF ILLUSTRATIVE EMBODIMENTS

Figure 1:
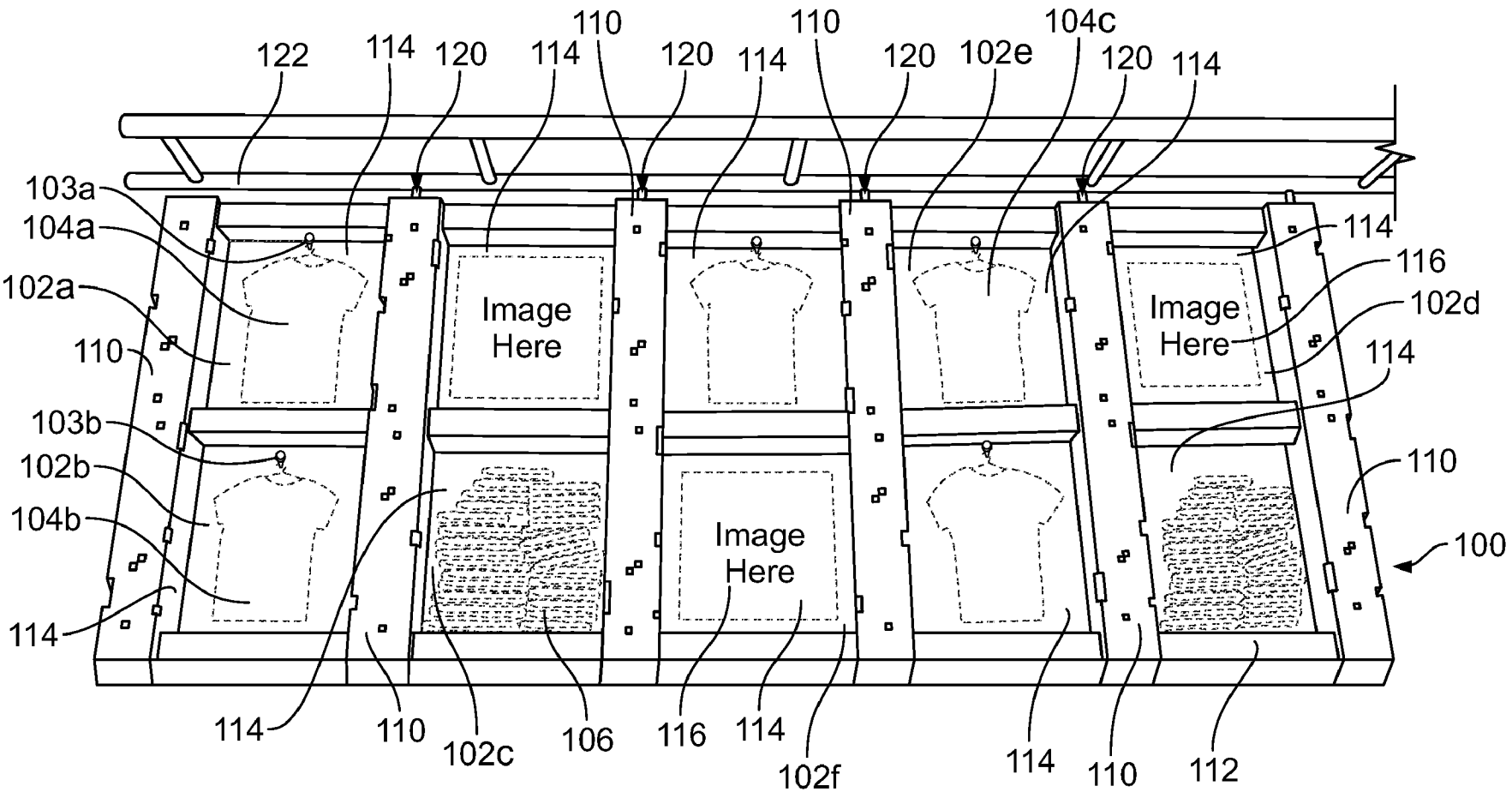
FIG. 1 is a front view of a display fixture, in accordance with some embodiments.

Referring to FIG. 1, some embodiments of a display fixture 100 can be configured to display a variety of products or images related to available products. For example, products or images of products displayed by the fixture 100 can include shirts, pants, other various apparel, fashion accessories, glassware, cookware, home décor products, wall decorations (pictures, paintings, posters), cleaning products, pharmaceutical products, and electronics.

The display fixture 100 can include one or more display windows 102 for physically and visually separating products and images of available products. Each display window 102 can be configured to display a product, product image, or group of products, or the like. For example, display windows 102*a* and 102*b* can display shirt products 104*a* and 104*b*, which may be suspended by a hanger coupled to the corresponding display window 102*a* or 102*b*. In some embodiments, the shirt products 104*a* and 104*b* can be positioned within the display windows 102*a* and 102*b* for display purposes only. In such circumstances, the shirt products 104*a* and 104*b* may comprise actual fabric shirts or cut-out cardboard material having a shape and image to resemble the actual shirt product. Quantities of shirts that are of the same or similar appearance as the shirt products 104*a* and 104*b* can be located on clothing racks or shelves below or adjacent to the display fixture 100. This allows a customer to select a style of a shirt or other apparel item by choosing from a variety of example shirts or apparel items displayed by the display fixture 100. The customer can then select an appropriately sized shirt or apparel item from a clothing rack or shelf located below or adjacent to the display fixture 100. It should be understood from the description herein that, in some embodiments, the products exhibited in the display fixture 100 can be any of the merchandise products listed above or a variety of other products.

Still referring to FIG. 1, the display window 102*b* can be configured to hold a plurality of shirts or other apparel items. For example, the display window 102*b* can include one or more hooks for receiving clothing hangers for a plurality of shirts. A customer can then select a desired size or style of shirt from the plurality of shirts. In addition or in the alternative, the display window 102*c* can hold one or more apparel items 106 in a stacked manner. For example, a plurality of pants 106 can be folded and stacked in the display window 102*c*. A customer can then select a desired size or style of pants from the display window 102*c*. In some embodiments, a display window can hold one or more of a variety of products. For example, a display window can hold a variety of soaps of varying scents and sizes to allow a customer to select a desired scent and size of soap. In another example, a display window can hold a variety of coffee mugs.

As shown in FIG. 1, one or more display windows 102*d* and 102*f* can receive graphic inserts 114 that display an image 116 related to an available product. In some embodiments, the image 116 can provide customers with a view of one or more products that are available for purchase, and each window 102 can display an image 116 that is different from the other images 116 displayed in other windows 102. A quantity of the one or more products displayed in the image 116 can be located elsewhere on the display fixture 100 or on clothing racks or shelves below or adjacent to the display fixture 100. In some embodiments, the image 116 in window 102*d* can be of a product located in a different section of a store that corresponds to items displayed by the display fixture 100. For example, a display window 102*e* can display a jogging shirt 104*c*. The image 116 in window 102*d* can be an image of a related item, such as jogging shoes that can be found in a shoe department of a store which contains the display fixture 100. Accordingly, some of the display windows 102*a-b* can display products 104*a-b* and 106 while other display windows 102*d-f* can display images of related accessories or merchandise.

In some embodiments, the image 116 can present information or messages to customers. For example, the image 116 in window 102*d* may present a message indicative of a promotional event (e.g., all products displayed by the display fixture 100 are "10% off" or otherwise discounted). As another example, the image 116 in window 102*d* can indicate that all athletic apparel will be on sale for a particular set of dates. In some embodiments, the image 116 can provide additional information about products displayed by the display fixture 100. For example, the image 116 in window 102*f* can indicate the brand name or trademark of products displayed by the display fixture 100. As another example, the image 116 in window 102*f* can indicate that all shirts displayed by the display fixture 100 are made from 100% cotton or other messages useful to customers.

In some embodiments, the image 116 displayed in a window 102 can be an image of an outfit that can be assembled from one or more products displayed by the display fixture 100. For example, the image 116 in window 102*f* can show a shirt of the same style as the shirt 104*b* along with a pair of pants and a belt that can also be purchased from a store that includes the display fixture 100. In some embodiments, the image 116 can be an image of something other than a product that is available for purchase. For example, the image 116 in window 102*d* can be a visually pleasing image or graphic to enhance the aesthetics of the display fixture 100. For example, if the display fixture 100 is being used to display a variety of luggage products, the image 116 in window 102*d* can be a picture of the Eiffel Tower. In some embodiments, a display window, such as the display window 102*d*, can display one or more objects of a purely decorative nature to enhance the aesthetics of the display fixture 100. For example, if the display fixture 100 is being used to display various western wear apparel items, the display window 102*d* can display a fake cactus to enhance the aesthetics of the display fixture 100. As another example, if the display fixture 100 is being used to display various bath products, the display window 102*d* can display a number of rubber ducks to enhance the aesthetics of the display fixture 100.

Still referring to FIG. 1, the display fixture 100 can be constructed from a plurality of support columns 110 and horizontal supports 112. The support columns 110 and horizontal supports 112 can be constructed from a ridged yet bendable material, for example, corrugated cardboard. Other materials that can be used to construct the support columns 110 and horizontal supports 112 can include plastic (including corrugated plastic), paperboard, foamcore board, and posterboard. Each support column 110 and horizontal support 112 can be manufactured as an integral flat piece of cardboard or other sheet material. Constructing the support columns 110 and horizontal supports 112 from flat pieces allows the flat pieces to be transported in a flat or non-folded condition. The flat pieces can be readily stacked and efficiently shipped in bulk from a manufacturer to a selected store. After the components 110 and 112 are delivered to the display site (e.g., a retail store in this particular embodiment), the flat pieces can be subsequently adjusted to a folded condition that provides the three-dimensional structures shown in FIG. 1 (described in more detail below in connection with FIGS. 4A-6B). When the columns 110 and supports 112 are manipulated to the folded condition, columns 110 and supports 112 can be assembled together in a toolless manner so as to provide the assembled display fixture 100. Accordingly, the components of the display fixture 100 can be transitioned by a store worker at a retail store display site from individual flat sheets to an assembly of three-dimensional structures without the use of handheld tools.

The display fixture 100 may have a modular construction so that a number of display windows 102 can be readily added or removed from the display fixture 100 by adding or removing support columns 110 and the corresponding horizontal supports 112. This modularity provides a user of the display fixture 100 with a high degree of flexibility in determining the number of display windows 102 to assemble for use at a display site. Also, the modularity of the display fixture 100 provides numerous options to a user when determining a location for the display fixture 100 within a retail store environment (e.g., because the size of the display fixture 100 can be selected to fit a given space).

Still referring to FIG. 1, in this embodiment, all of the display windows 102 receive a graphic insert 114 therein. The graphic insert 114 may comprise a substantially planar panel that bears at least one image 116 thereon. As previously described, the graphic insert 114 arranged in one window 102 may have a different appearance from the graphic insert 114 arranged in a second window 102. For example, the display window 102*f* can be fitted with the graphic insert 114 to display an image of a particular product while the graphic insert 114 in the display window 102*d* displays an image of a different type of product. The graphic insert 114 can be constructed from a rigid yet bendable material, for example, corrugated cardboard. Other examples of materials that can be used to manufacture the graphic insert 114 can include plastic (including corrugated plastic), paperboard, foamcore board, and posterboard. The graphic insert 114 can be manufactured as a single flat piece of cardboard or other material. Constructing graphic inserts from flat pieces permits the graphic inserts 114 to be readily stacked and efficiently shipped in bulk from a manufacturer to a selected store (as previously described for the support columns 110 and horizontal supports 112). The graphic insert 114 frictionally engages one or more inner surfaces of the display window 102 so that the graphic insert 114 can be toollessly assembled at the display site (e.g., without the use of handheld tools) as part of the display fixture 100.

The graphic insert 114 can be inserted into the display window 102*f* and held in place by a friction fit. For example, the graphic insert 114 can include flaps on the top, bottom, and sides that can contact the sides of the horizontal supports 112 and support columns 110 to create a friction fit and hold the graphic insert 114 in place. The graphic insert 114 can be used to adjust the depth of the display window 102*f*. The graphic insert 114 can be slid forward or backward within the display window 102*f* in order to change the depth. For example, the graphic insert 114 can be positioned towards the rear the display fixture 100 in order to create a relatively deep depth of the display window 102*f* to allow for stacks of folded clothes to be placed in the display window 102*f*. As another example, the graphic insert 114 can be positioned towards the front of the display fixture 100 in order to create a relatively shallow depth of the display window 102*f* to create a more visually pleasing aesthetic when a single item, such as a hanging t-shirt, is positioned in the display window 102*f*. The graphic insert 114 can also be positioned at a variety of depths between the rear and front of the display fixture 100.

Still referring to FIG. 1, in some embodiments, the graphic insert 114 can include a first image 116 upon a first major surface. The graphic insert 114 can further include a second image, different from the first image 116, on an opposing major surface opposite the first major surface (described in more detail below in connection with FIGS. 3A-B). This can allow a user of the display fixture 100 to select between two different display options for each graphic insert 114 in each display window 102. For example, the display window 102*f* can show a first image 116 that faces outward toward consumers, and the user has the option to reverse the orientation of the graphic insert 114 within the display window 102*f* in order to display a second image (that is different from the first image 116). Reversing the orientation of the graphic insert 114 can cause the appearance of the display fixture 100 to be substantially different. This modularity can be convenient when the display fixture is used in one part of a store to market a first type of products and subsequently used in a second part of the store to market a different type of products.

For example, a set of graphic inserts 114 can each have a first side and a second side. The first sides of the graphic inserts 114 can include images of soccer balls, basketballs, running tracks, and roller blades. The graphic inserts 114 can be inserted into the display fixture 100 with the first sides displayed when the display fixture 100 is used to display athletic apparel and accessories. The second sides of the graphic inserts 114 can include images of food, cookware, and kitchen appliances. The orientation of the graphic inserts 114 can be reversed to display the second sides of the graphic inserts to allow the display fixture 100 to be used to display a variety of cooking related products.

In some embodiments, available merchandise products can be placed within the display window 102*f* in front of the graphic insert 114 as described above. For example, one or more pants 106 can be hung within the display window 102*c* in front of the graphic insert 114, thereby revealing a portion of the image on the insert 114. Also, graphic inserts 114 can be placed in some display windows 102 without a display product to enhance the aesthetics of the display fixture 100.

Still referring to FIG. 1, the display fixture 100 can include one or more hooks 103 for hanging products in the display windows 102. For example, the display window 102*b* can include a hook 103*b* for hanging the shirt 104*b*. In some embodiments, the hooks 103 can protrude from or be integral with the graphic inserts 114. For example, the graphic insert 114 can support a hook for receiving and displaying a shirt within the display window 102*f*. In alternative embodiments, hooks 103 can be suspended from the horizontal supports 112. In some embodiments, the horizontal supports 112 can include cut away portions for receiving clothing hangers. This can allow for a hanging apparel item, such as the shirt 104*b*, to be displayed within a display window without the use of additional hooks.

In some embodiments, the display fixture 100 can include mounting supports 120 for mounting the display fixture to a wall or ceiling. For example, as shown in FIG. 1, the mounting supports 120 can extend from the top of the display fixture 100 (e.g., coupled to one or more support columns 110) to secure with one or more ceiling rails 122, thereby suspending the assembled display fixture 100 from the ceiling rails 122. In some embodiments, mounting supports 120 can extend from the rear of the display fixture 100 to allow the display fixture to be attached to a wall or other vertical support structure.

Figure 2:
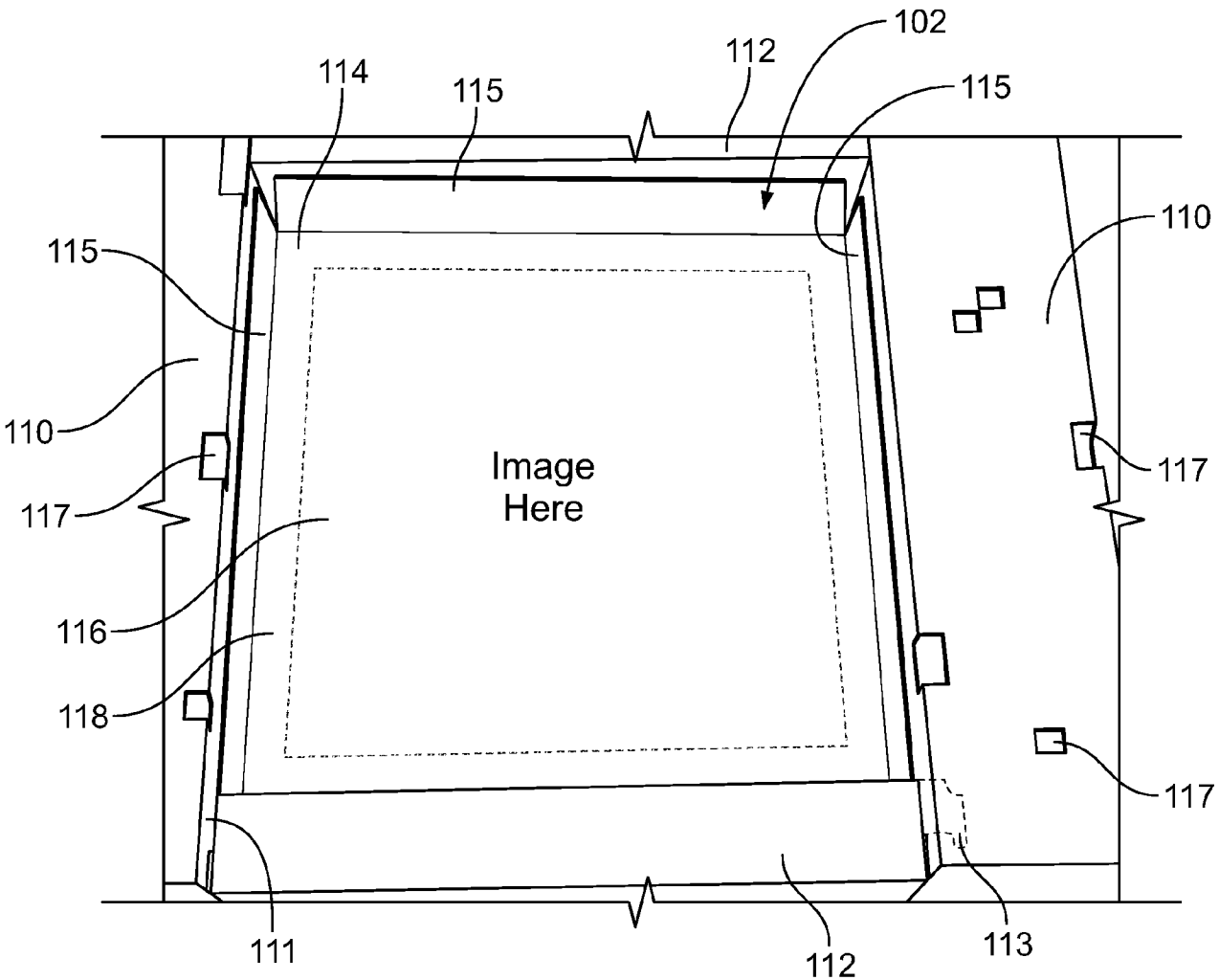
FIG. 2 is a front view of a display window of the display fixture of FIG. 1, in accordance with some embodiments.

Referring now to FIG. 2, in some embodiments, each display window 102 of the display fixture 100 can be defined by a pair of support columns 110 and a pair of horizontal supports 112. In some embodiments, the lower horizontal support 112 can act as a shelf for supporting available products or other items for display within the display window 102. For example, as previously described in connection with FIG. 1, various apparel items can be folded and stacked on the lower horizontal support 112 to allow customers to easily view and select from among the various apparel items.

The horizontal supports 112 can mate with an adjacent support column 110 during a toolless assembly process. For example, each of the horizontal supports 112 can include one or more tabs 113 that can extend into and mate with a corresponding slot (FIG. 4A) defined by the adjacent support column 110. The support columns 110 can further include additional slots for receiving other tabs 113 extending from the horizontal supports 112. For example, the support columns 110 can include a plurality of slots to allow the horizontal supports 112 to be attached to the support columns 110 at various different heights. This can allow a user to change the height of the display window 102 by adjusting the heights of the horizontal supports 112 with respect to the support columns 110.

In some embodiments, the horizontal supports 112 can have different depths than the support columns 110, as shown in the example depicted in FIG. 2. For example, the horizontal supports 112 can have a first depth, and the support columns 110 can have a second depth that is greater than the first depth. This allows the support columns 110 to have a portion 111 that extends forward beyond the horizontal supports 112. In some embodiments, the support columns 110, the horizontal supports 112, or a combination thereof can include a number of decorative cutouts 117 to enhance the aesthetic appeal of the display fixture 100.

Still referring to FIG. 2, the display window 102 can receive a corresponding graphic insert 114 that includes one or more flaps 115 to frictionally engage the inner surfaces of the display window 102. For example, the graphic insert 114 can be equipped with four flaps 115 that are arranged on the top, bottom, and sides of the insert and at least partially defined by a fold line. The flaps 115 can contact the support columns 110 and horizontal supports 112 to create a friction fit that releasably secures the graphic insert 114 in place within the display window 102. In some embodiments, the width of the flaps 115 can be more than half the depth of the horizontal support 112, but less than the entire depth of the horizontal support 112. Such a configuration can provide a worker or other user with the option to select the depth of the image 116 arranged in the display window 102.

Figure 3A:
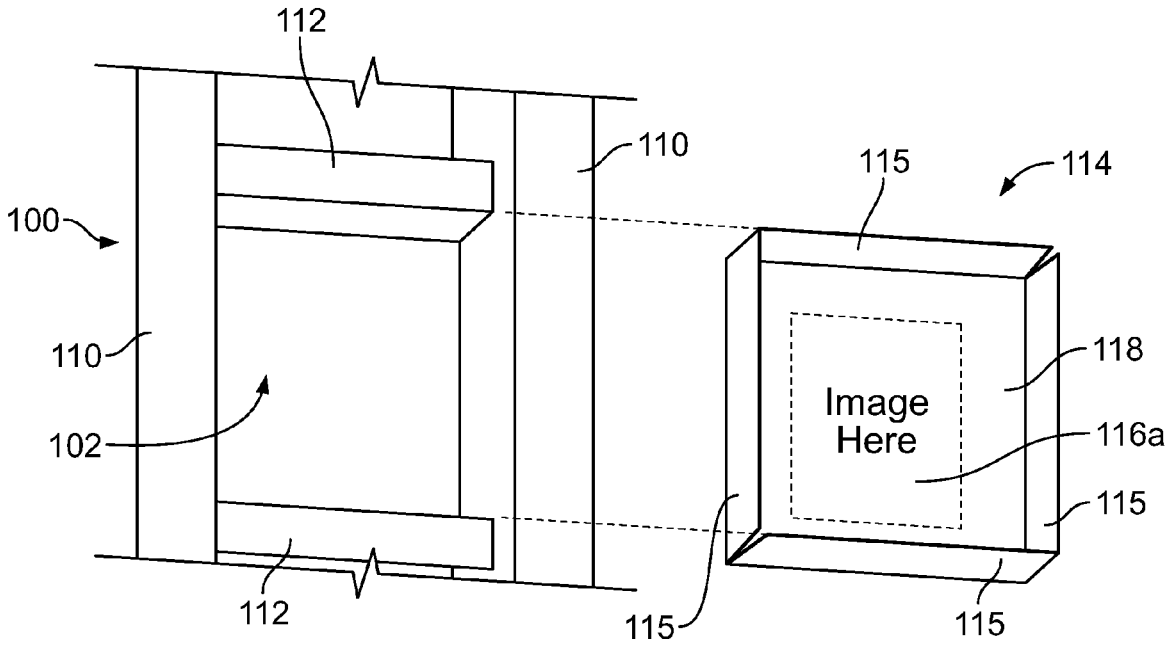
FIG. 3A is an exploded view of a display window and a graphic insert, in accordance with some embodiments.
Figure 3B:
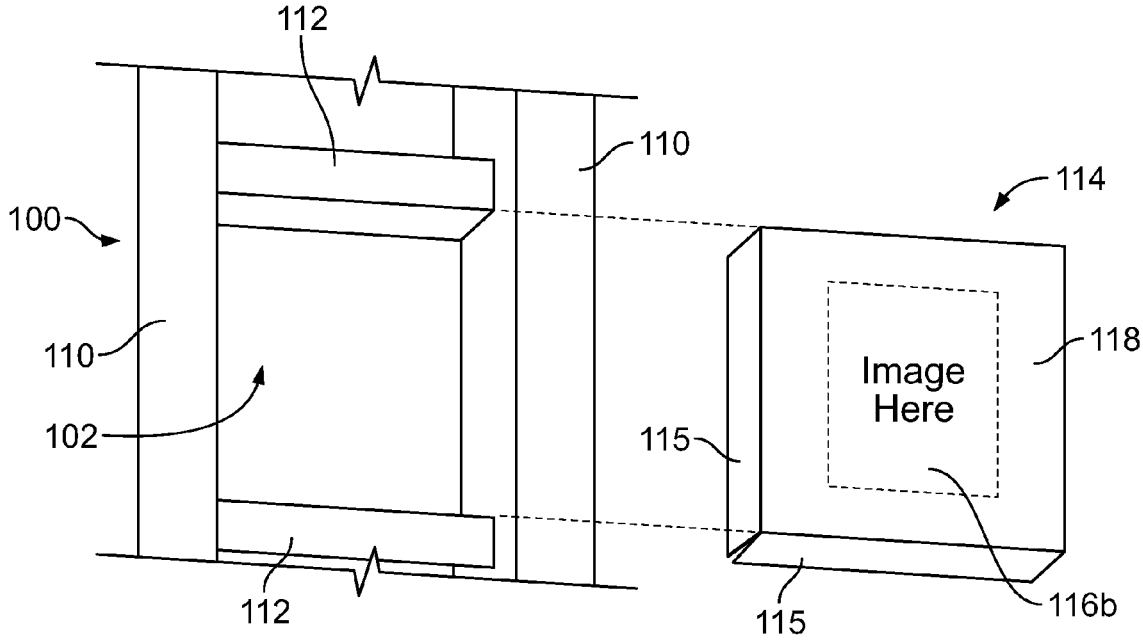
FIG. 3B is an exploded view of a display window and a graphic insert, in accordance with some embodiments.

Referring now to FIGS. 3A-B, the graphic insert 114 can be inserted into the display window 102 in a first configuration (FIG. 3A) with the flaps 115 extending in a forward direction relative to the display window 102 so that a main portion 118 of graphic insert 114 is substantially flush with the rear plane of the display window 102. In a second configuration (FIG. 3B), the graphic insert 114 can be inserted with the flaps 115 extending in a rearward direction relative to the display window 102 so that the main portion 118 of the graphic insert 114 extends in a direction that is forward of the rear plane of the display window 102. In this second configuration, the graphic insert 114 provides a shallower depth for the display window 102 (when viewing from the front) than if the graphic insert 114 is arranged in the first configuration. Because a store worker has multiple display depth options for each window 102 of the display fixture 100, the store worker can create numerous different appearances for the same display fixture without the use of handheld tools.

As shown in FIGS. 3A-B, installation of the graphic insert 114 can be accomplished by hand without the use of tools. The main portion 118 of the graphic insert 114 can be directed by hand into the display window 102. The flaps 115 can contact the inner surfaces of the window 102 (defined by the support columns 110 and the horizontal supports 112) to frictionally engage the window 102. As such, the graphic insert 114 can be releasably retained in the window 102 to display the first image 116*a* at a first depth, and can be readily reversed by hand to display the second image 116*b* at a second depth. Further, each display fixture 100 can be provided with a number of different graphic inserts 114, each of which are configured to be received in a number of different display windows 102. The graphic insert 114 can be readily exchangeable with different graphic inserts 114 to provide the user with a number of display options. Accordingly, the display options provided to the user can be implemented at selected times to coincide with sales events, promotional events, seasons, holidays or other events. For example, a graphic insert 114 having an image of a jack-o-lantern can be inserted into the display window 102 to correspond with Halloween. As another example, a graphic insert 114 having an image of snowflakes can be inserted into the display window 102 to correspond with a winter holiday sale. The images displayed in the display window 102 can also be changed to correlate with a change of products being displayed in or near the display window 102. In some embodiments, the height of the display window 102 can be changed by inserting the horizontal supports 112 into different sets of slots in the support columns 110 (as previously described in connection with FIG. 2). Accordingly, graphic inserts 114 of various sizes can be provided to correspond to varying sizes of the display window 102.

Still referring to FIGS. 3A-B, in some embodiments, the graphic insert 114 can include a second image 116*b* that is different from the first image 116*a* shown in FIG. 3A. The second image 116*b* is located on an opposing major surface of the main portion 118 from the image 116*a*. The entire graphic insert 114 can be flipped (with respect to the orientation shown in FIG. 3A) so that the flaps 115 remain in the same position relative to the main portion 118, but extend in a rearward direction relative to the display window 102. This allows the second image 116*b* of the graphic insert 114 to be displayed at a depth in the display window 102 that is different from the depth of the first image 116*a* depicted in FIG. 3A. In some alternative embodiments, the graphic insert 114 can be flipped with respect to the orientation shown in FIG. 3A (so as to expose the second image 116*b*), but the flaps 115 can then be folded to face in a forward direction relative to the display window 102. Accordingly, the second image 116*b* of the graphic insert 114 can be displayed at a depth in the display window 102 that is substantially similar to the depth of the first image 116*a* depicted in FIG. 3A.

Figure 4A:
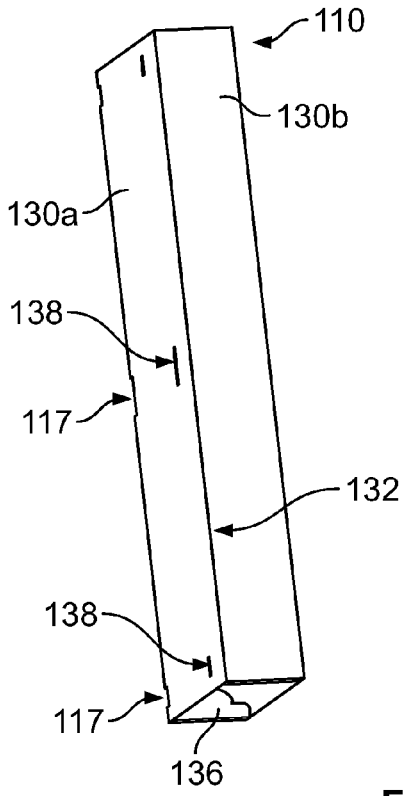
FIG. 4A is a perspective view of a display fixture support column in an assembled form, in accordance with some embodiments.
Figure 4B:
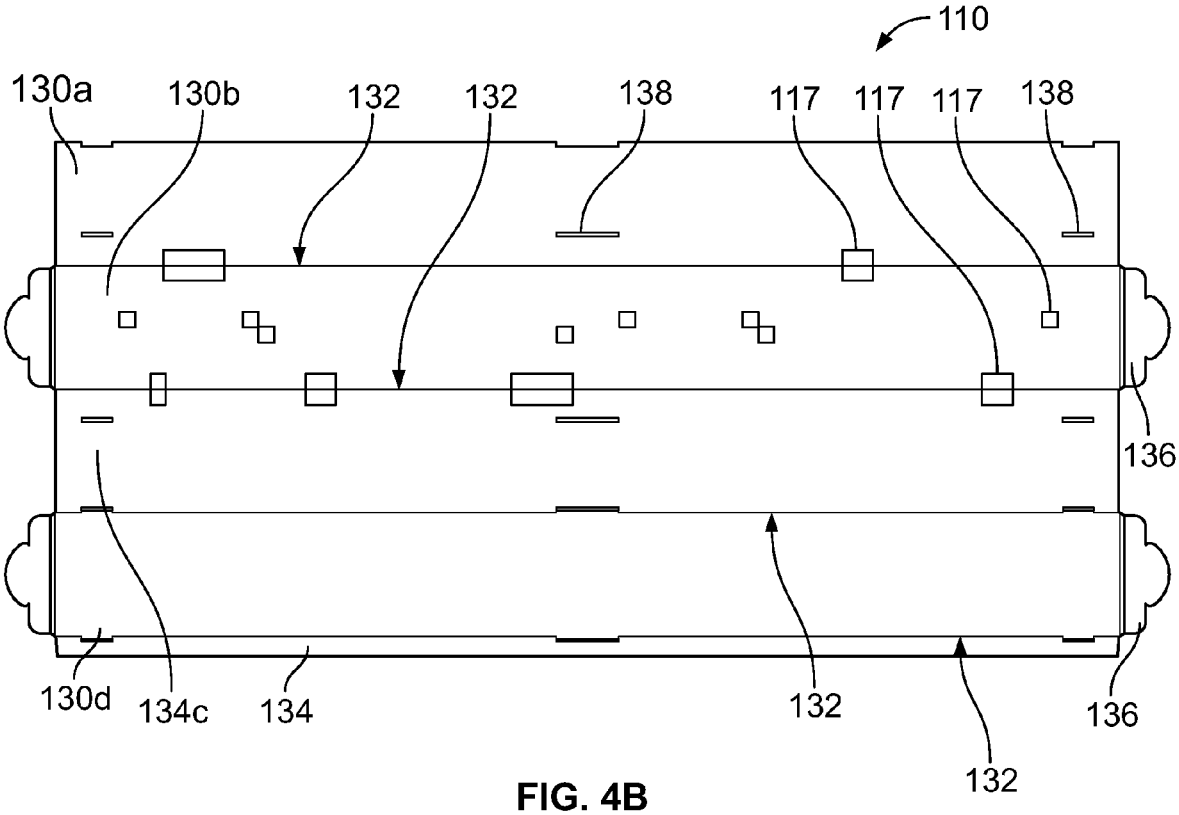
FIG. 4B is a top view of the display fixture support column of FIG. 4A in a flat form, in accordance with some embodiments.

Referring now to FIGS. 4A and 4B, each of the support columns 110 for the display fixture 100 can be adjusted from a flat configuration (FIG. 4B) to an operative configuration (FIG. 4A) at a display site. As previously described, the support column 110 can be manufactured from sheet material (e.g., corrugated cardboard material or the like) to provide the flat configuration before a plurality of support columns 110 (in the flat configuration) are stacked and efficiently shipped from a manufacturer to a display site at a retail store.

Each support column 400 can include a plurality of generally rectangular panels 130*a-d* that are separated by fold lines 132. In the example depicted, the support column 110 includes four of the foldable panels 130. In some alternative embodiments, support column 110 can have more or less than four of the foldable panels 130 (e.g., six panels 130 to provide a hexagonal prism). Also, in some alternative embodiments, the panels 130 can be shapes other than the generally rectangular shape depicted in FIGS. 4A-B.

In some embodiments, the support column 110 can be manually assembled at the display site from the flat configuration (FIG. 4B) to the operative configuration (FIG. 4A) without the use of handheld tools. The support column 110 can include fold lines 132 to allow the support column 110 to be readily folded into a three-dimensional structure. The fold lines 132 can indicate to a user where each panel 130*a-d* is to be folded during assembly. The support column may also include a side tab 134 that is equipped with an adhesive (e.g., an adhesive strip with a removal liner, or the like). As such, the side tab 134 can be adhered to an interior surface of the first panel 130*a* to hold the support column 110 in the operative configuration. The support column 110 may include one or more end tabs 136 at the top and bottom of the support column 110. The tabs can be affixed to each other (e.g., using an adhesive strip with a removal liner, or the like). Attaching the end tabs 134 provides additional support to retain the support column 110 in the operative configuration.

Still referring to FIGS. 4A-B, the support column 110 can be assembled by bending the support column 110 along the fold lines 132 so that the panels 130*a-d* form generally perpendicular angles with respect to each other. The side tab 134 can be positioned to form a generally perpendicular angle with the panel 130*d* and positioned to fit under a portion of the panel 130*a*. Then, the end tabs 134 can be affixed to each other to further secure the support column 110.

The support column 102 can include slots 138 for receiving tabs 113 of horizontal supports 112 (as previously described in connection with FIG. 2). The support column 110 can include the slots 138 at different heights along the body of the support column 110 to allow the horizontal supports 112 to be attached to the support column 110 at different height options. It should be understood from the description herein that, in alternative embodiments, the slots 138 may be defined in the horizontal supports 112 while the mating tabs 113 extend from the support columns 110. In some embodiments, the support column 110 can include a number of decorative cut outs 117 or patterns to enhance the visual appeal of the support column 110. Furthermore, it should be understood from the description herein, that in some embodiments, one or more of the panels 130*a-d* can include images to enhance the aesthetics of the support column 110.

Figure 5A:
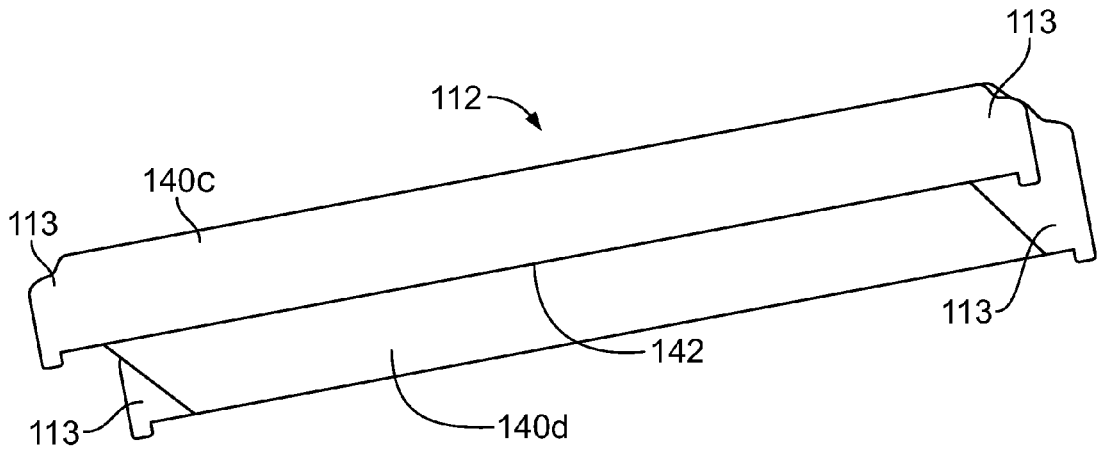
FIG. 5A is a perspective view of a display fixture horizontal support in an assembled form, in accordance with some embodiments.
Figure 5B:
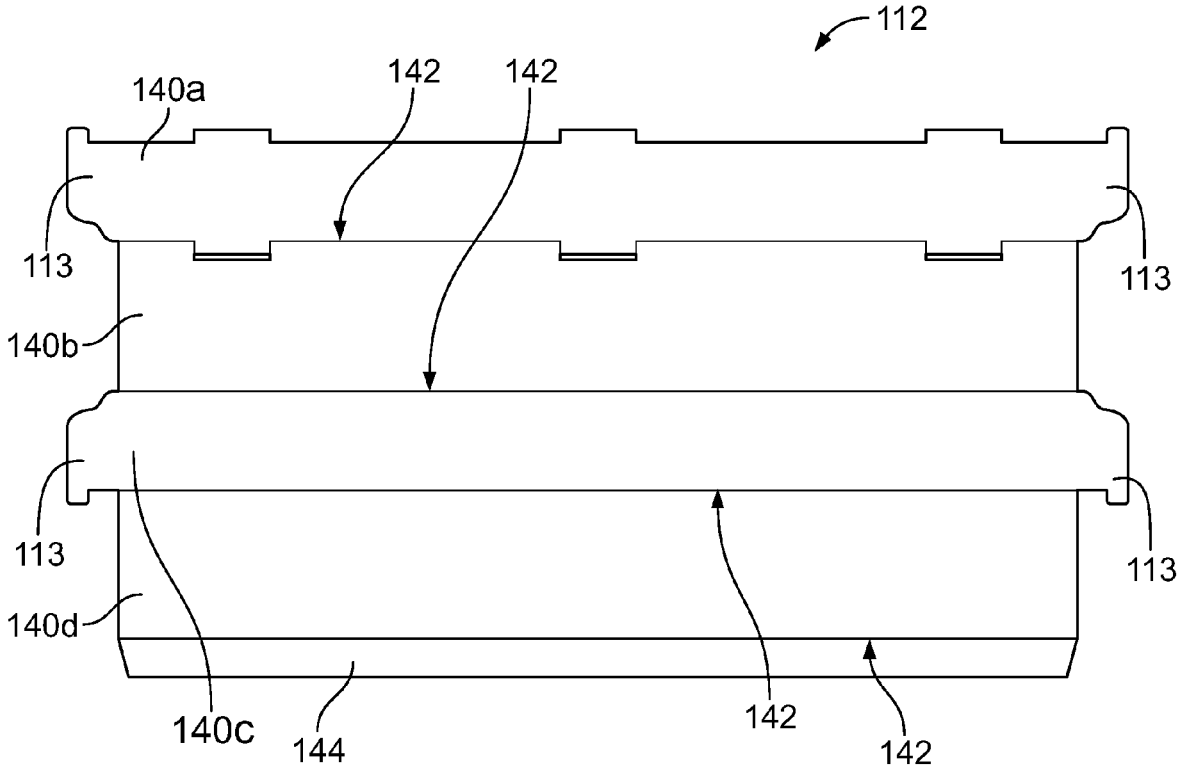
FIG. 5B is a top view of the display fixture horizontal support of FIG. 5A in a flat form, in accordance with some embodiments.

Referring now to FIGS. 5A and 5B, each of the horizontal supports 112 for the display fixture 100 can be adjusted from a flat configuration (FIG. 5B) to an operative configuration (FIG. 5A) at a display site. As previously described, the horizontal support 112 can be manufactured from sheet material (e.g., corrugated cardboard material or the like) to provide the flat configuration before a plurality of horizontal supports 112 (in the flat configuration) are stacked and efficiently shipped from a manufacturer to a display site at a retail store.

Each horizontal support 112 can include a plurality of generally rectangular panels 140*a-d* that are separated by fold lines 142. In the example depicted, the horizontal support 112 includes four of the foldable panels 140. In some alternative embodiments, the horizontal support 112 can have more or less than four of the foldable panels 140 (e.g., six panels 140 to provide a hexagonal prism). Also, in some alternative embodiments, the panels 140 can be shapes other than the generally rectangular shape depicted in FIGS. 5A-B.

In some embodiments, the horizontal support 112 can be manually assembled at the display site from the flat configuration (FIG. 5B) to the operative configuration (FIG. 5A) without the use of handheld tools. The horizontal support 112 can include fold lines 142 to allow the horizontal support 112 to be readily folded into a three-dimensional structure. The fold lines 142 can indicate to a user where each panel 140*a-d* is to be folded during assembly. The support column may also include a side tab 144 that is equipped with an adhesive (e.g., an adhesive strip with a removal liner, or the like). As such, the side tab 144 can be adhered to an interior surface of the first panel 140*a* to hold the horizontal support 112 in the operative configuration.

Still referring to FIGS. 5A-B, the support column 110 can be readily assembled by bending the horizontal support 112 along the fold lines 142 so that the panels 140*a-d* form generally perpendicular angles with respect to each other. The side tab 144 can be positioned to form a generally perpendicular angle with the panel 140*d* and positioned to fit under a portion of the panel 140*a*.

The horizontal support 112 can include the connection tabs 113 for attaching to corresponding slots 138 of an adjacent support column 110 (as previously described in connection with FIG. 2). The connection tabs 113 can be inserted into slots 138 (FIGS. 4A-B) located on the sides of support columns 110 so as to provide a secure connection between the horizontal support 112 and the adjacent support column 110. The horizontal support 112 can be assembled along with a number of support columns and other horizontal supports to form the display fixture 110, such as the embodiment of the display fixture 100 shown in FIG. 1. It should be understood from the description herein that, in alternative embodiments, the slots 138 may be defined in the horizontal supports 112 while the connection tabs 113 extend from the support columns 110. The panel 140*b* can form a top surface of the horizontal support 112 and act as a generally horizontal shelf for holding and displaying available merchandise products and other display items (as previously described in connection with FIG. 1). In some embodiments, one or more of the panels 140*a-d* can include images, patterns, or decorative cut outs to enhance the appearance of the horizontal support 112.

Figure 6A:
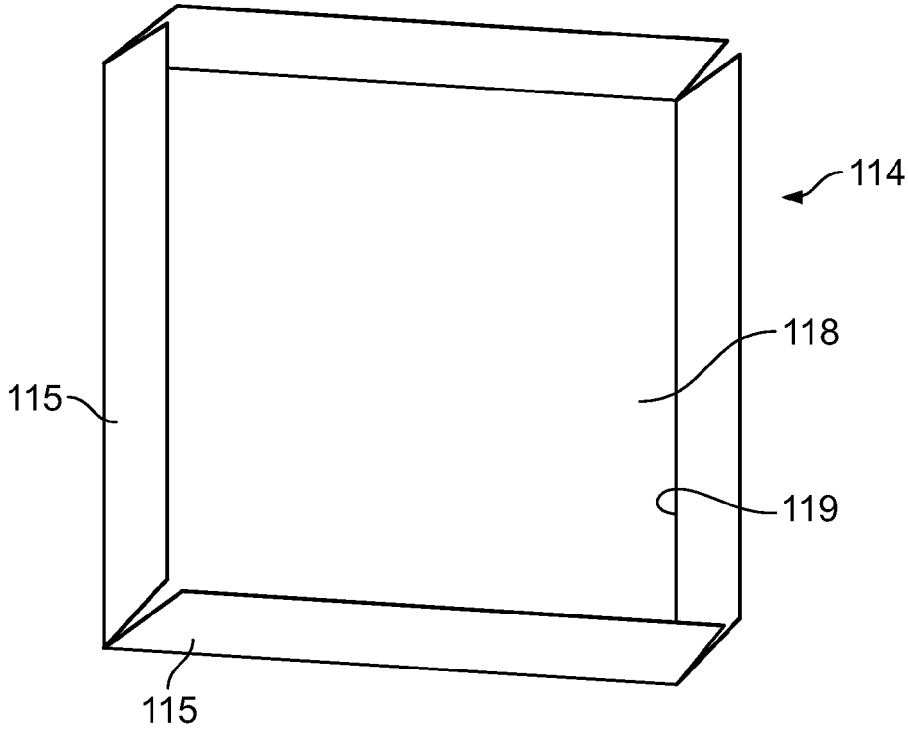
FIG. 6A is a perspective view of a display fixture graphic insert in an assembled form, in accordance with some embodiments.
Figure 6B:
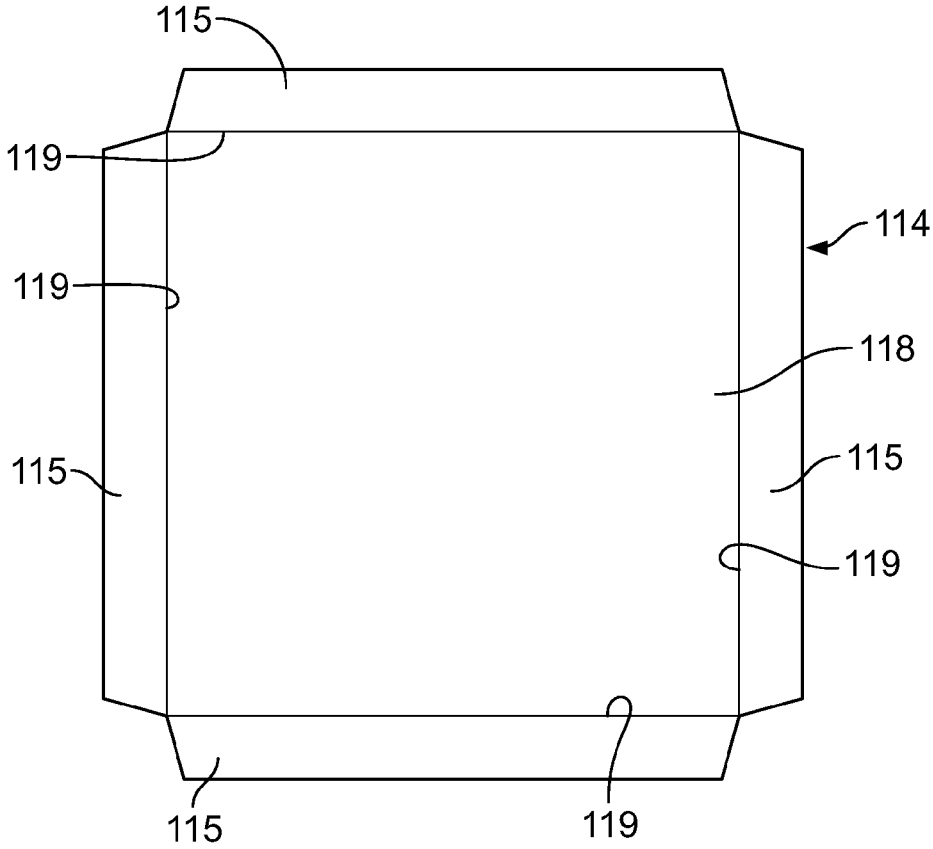
FIG. 6B is a top view of the display fixture graphic insert of FIG. 6A in a flat form, in accordance with some embodiments.

Referring now to FIGS. 6A and 6B, each of the graphic inserts 114 for the display fixture 100 can be adjusted from a flat configuration (FIG. 6B) to an operative configuration (FIG. 6A) at a display site. As previously described, the graphic insert 114 can be manufactured from sheet material (e.g., corrugated cardboard material or the like) to provide the flat configuration before a plurality of graphic inserts 114 (in the flat configuration) are stacked and efficiently shipped from a manufacturer to a display site at a retail store.

As previously described, each graphic insert 114 includes a main portion 118 (having first and second major surfaces) and a plurality of flaps 115 extending therefrom. The main portion 118 defines first and second major surfaces, which can bear images related to available products or other information. In this embodiment, the main portion 118 has a four-sided shape with one flap 115 extending from each side. Each flap 115 is separated from the main portion 118 by a fold line 119, which can facilitate assembly in to the operative configuration. The flaps 115 can be used to create a friction engagement with the inner walls of the display window 102 (as defined by the support columns 110 and the horizontal supports 112). When installed in a display window 102, the graphic insert 114 can be used to change the depth of the display window 102 (as previously described in connection with FIGS. 3A-B).

In some embodiments, the graphic inserts 114 can be manufactured with selected flap lengths to allow the depth of a display window 102 to be predetermined depending upon the selected length of the flaps 115 for a particular insert 114. In some alternative embodiments, the flaps 115 of the graphic insert 114 can be trimmed using a box cutter or scissors to change the depth of a display window 102 into which the graphic insert 114 has been inserted. In further embodiments, the flaps 115 of the graphic insert 114 can be adhered in the display window 102. Alternatively, the flaps 115 of the graphic insert 114 can include tabs for securing the graphic insert 114 within mating slots defined in the inner walls of the display window 102.

Figure 7:
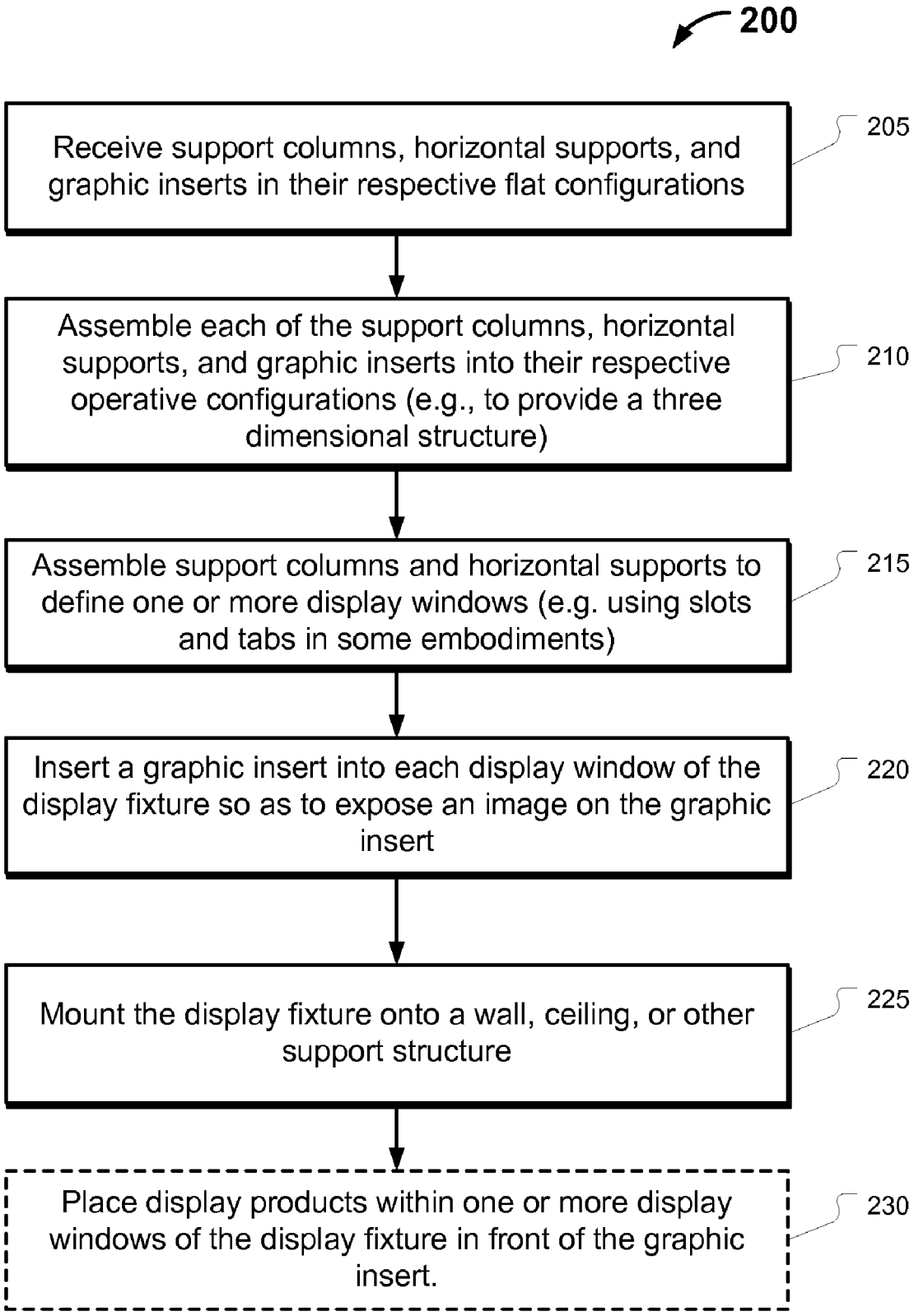
FIG. 7 is a flow chart of an example method for assembling a display fixture.

Referring now to FIG. 7, some embodiments of a process 205 for assembling a display fixture 100 can include an operation 205 of receiving a plurality of support columns 110, horizontal supports 112, and graphic inserts 114 in their respective flat configurations. For example, as previously described in connection with FIGS. 4B, 5B, and 6B, the support columns 110, horizontal supports 112, and graphic inserts 114 can be manufactured from sheet material (e.g., corrugated cardboard material or the like) to provide the flat configuration before being transported from a manufacturer to a display site at a retail store In operation 210, a user can assemble each of the support columns 110, horizontal supports 112, and graphic inserts 114 into their respective operative configurations. For example, the support columns 110 can be folded along fold lines 132 and assembled into their operative configuration as described in connection with FIG. 4A. As another example, the horizontal supports 112 can be folded along fold lines 142 and assembled into their operative configuration as described in connection with FIG. 5A. Similarly, the graphic inserts 114 can be folded along the fold lines 119 as described in connection with FIG. 6A. In some embodiments, the support columns 110, horizontal supports 112, and graphic inserts 114 can be toollessly assembled by hand without the use of handheld tools.

In operation 215, the user can assemble the support columns 110 and the horizontal supports 112 to define one or more display windows 102 in the display fixture. For example, the tabs 113 of the horizontal supports 112 can be mated with the corresponding slots 138 of the support columns 110 so as to define one display window 102, two display windows 102, four display windows 102, six display windows, 102, eight display windows 102, ten display windows 102 (refer to FIG. 1), or more. As previously described, the user can assemble the display fixture to a selected size by using more or less support columns 110 and horizontal supports 112. For example, with reference to the display fixture 100 shown in FIG. 1, two additional display windows 102 can be added to the display fixture 100 by adding one support column and three horizontal supports to the side of the depicted display fixture 100.

In operation 220, the user can insert a graphic insert 114 into each display window 102 of the display fixture 100 so as to expose an image 116 on the graphic insert 114. For example, the graphic insert 114 can be inserted into a display window 102 as shown in FIG. 3A or FIG. 3B. As previously described, the graphic insert can be releasably secured in the display window 102 without the use of handheld tools.

In operation 225, the user can mount the display fixture 100 onto a wall, ceiling, or other support structures. For example, as described in connection with FIG. 1, the display fixture 100 can employ the mounting supports 120 to couple with ceiling rails 122 at the display site using mounting supports 120. As another example, the mounting supports 120 can be arranged on the rear of the display fixture 100 for mounting to a wall or another vertical support structure.

Optionally, in operation 230, the user can place display products within one or more of the display windows 102 of the display fixture 100. For example, as previously described in connection with FIG. 1, the display window 102 can receive clothing items, fashion accessories, glassware, cookware, home décor products, wall decorations (pictures, paintings, posters), cleaning products, pharmaceutical products, and electronics. In some circumstances, the display window 102 can be equipped with a hook 103. In one example, one or more shirts can be hung from clothing hangers and placed within the display window for display. In other scenarios, the horizontal support 112 may serve as a shelf to receive the display products. In one example, several types of pants can be folded and stacked within a display window. As another example, a variety of hair care products can be placed within the display window.

A number of embodiments of the invention have been described. Nevertheless, it will be understood that various modifications may be made without departing from the spirit and scope of the invention. Accordingly, other embodiments are within the scope of the following claims.

What is claimed is:

1. A product display apparatus, comprising:

one or more display windows defined by a plurality of vertical support members that are adjustable from a flat configuration to an operative configuration and a plurality of horizontal support members that are adjustable from a flat configuration to an operative configuration; and an image-bearing insert frictionally engaged in each of the display windows so as to expose from the display window a first image on a first major surface of the image-bearing insert, the image-bearing insert comprising a plurality of foldable flaps that abut with inner walls of the display window defined by the plurality of vertical support members and the plurality of horizontal support members, wherein the first major surface of the image-bearing insert rests at a first depth in the display window when the foldable flaps extend forward from the first major surface of the image-bearing insert and rests at a second different depth in the display window when the foldable flaps extend rearward from the first major surface of the image-bearing insert.

2. The product display apparatus of claim 1, wherein the plurality of vertical support members are adjustable from the flat configuration in which each vertical support member is in sheet form to the operative configuration in which each vertical support member is folded to a three-dimensional structure.

3. The product display apparatus of claim 2, wherein the plurality of horizontal support members are adjustable from the flat configuration in which each horizontal support member is in sheet form to the operative configuration in which each horizontal support member is folded to a three-dimensional structure.

4. The product display apparatus of claim 3, wherein the each image-bearing insert is adjustable from a flat configuration in which the image-bearing insert is in sheet form to an operative configuration in which the image-bearing insert is folded so that the flaps are non-planar with the first major surface.

5. The product display apparatus of claim 3, wherein the plurality of vertical support members are toollessly mounted to the plurality of horizontal support members to define an array of display windows.

6. The product display apparatus of claim 5, wherein the array of display windows comprises a plurality of the display windows in a side-by-side configuration so that each window opening in the array of display windows faces in a similar forward direction.

7. The product display apparatus of claim 6, wherein each display window in the array of display windows receives a corresponding image-bearing insert that comprises the first image on the first major surface and a second different image on a second major surface opposite the first major surface, wherein the corresponding image-bearing insert is adjustable from a first orientation in which the first image is viewable through the display window to a second orientation in which the second different image is viewable through the display window.

8. The product display apparatus of claim 1, wherein the image-bearing insert displays the first image forward through the display window when the first major surface of the image-bearing insert rests at the first depth, and wherein the image-bearing insert displays a second different image forward through the display window when the first major surface of the image-bearing insert rests at the second depth in the display window.

9. The product display apparatus of claim 8, wherein the first image on the first major surface of the image-bearing insert being related to store products, and the second different image being on a second major surface of the image-bearing insert opposite the first major surface.

10. The product display apparatus of claim 1, further comprising one or more mounting supports extending upward away from the display windows and coupled to a ceiling mounting rack.

11. A product display fixture that is ceiling-mounted in a retail store environment, comprising:

an array of display openings defined by a plurality of vertical support columns that are toollessly mounted to a plurality of horizontal support members, each of the vertical support columns being adjustable from a non-folded configuration to a folded configuration, and each of the horizontal support members that are adjustable from a non-folded configuration to a folded configuration;

one or more mounting supports extending upward away from the display openings and coupled to a ceiling mounting rack so that the array of display openings is suspended from the ceiling mounting rack; and a plurality of graphic planar members arranged in the array of display openings, each of the graphic planar members having a first image related to store products arranged on a first major surface and a second different image arranged on a second major surface opposite from the first major surface, each of the graphic planar members comprising a plurality of foldable flaps that abut with inner walls of a corresponding display opening in the array of display openings, wherein each of the graphic planar members is adjustable from a first orientation in which the first image is exposed from the corresponding display opening to a second orientation in which the second different image is exposed from the corresponding display opening.

12. The product display fixture of claim 11, wherein the first major surface of the graphic planar member rests at a first depth in the display opening when the graphic planar member is arranged in the first orientation to expose the first image, and wherein the second major surface of the graphic planar member rests at a second different depth in the display opening when the graphic planar member is arranged in the second orientation to expose the second image.

13. The product display apparatus of claim 12, wherein the array of display openings comprises a plurality of the display openings in a side-by-side configuration so that each display opening faces in a similar forward direction.

14. The product display fixture of claim 11:

wherein the plurality of vertical support columns are adjustable from the non-folded configuration in which each vertical support column is in sheet form to the folded configuration in which each vertical support column is folded to a three-dimensional structure, and wherein the plurality of horizontal support members are adjustable from the non-folded configuration in which each horizontal support member is in sheet form to the folded configuration in which each horizontal support member is folded to a three-dimensional structure.

15. The product display fixture of claim 14, wherein the each graphic planar member is adjustable from a flat configuration in which the graphic planar member is in sheet form to an operative configuration in which the graphic planar member is folded so that the flaps extend transversely from the first and second major surfaces.

16. A method of assembling a product display apparatus, comprising:

receiving one or more stacks of a plurality of vertical support members, a plurality of horizontal support members, and a plurality of image-bearing panels;

adjusting each of the vertical support members, horizontal support members, and image-bearing panels from a flat configuration to a folded configuration;

toollessly mounting the plurality of vertical support members to the plurality of horizontal support members to define an array of display windows;

releasably securing the image-bearing panels in the array of display windows so that images on first major surfaces of the image-bearing panels are displayed forward through the array of display windows while images on second major surfaces of the image-bearing panels face rearwardly; and mounting one or more of the vertical support members and horizontal support members to a ceiling or wall in a retail store environment so that the display windows and image-bearing panels are viewable in the retail store environment.

17. The method of claim 16, wherein adjusting the vertical support members from the flat configuration to the folded configuration comprises folding the vertical support members from the flat configuration in which each vertical support member is in sheet form to the folded configuration in which each vertical support member is folded to a three-dimensional structure.

18. The method of claim 17, wherein the step of receiving comprises receiving the plurality of vertical support members, the plurality of horizontal support members, and the plurality of image-bearing panels from a location that is remote from the retail store environment.

19. The method of claim 18, wherein the step of mounting comprises coupling one or more mounting supports to a ceiling mounting rack in the retail store environment, the mounting supports extending upward from at least one of the plurality of vertical support members and the plurality of horizontal support members.

20. The method of claim 16, wherein toollessly mounting the plurality of vertical support members to the plurality of horizontal support members comprises inserting tabs that extend from one of the vertical support members and horizontal support members into a mating slot of an adjacent one of the vertical support members and horizontal support members.

* * * * *